United States Patent [19]

Matsuoka

[11] Patent Number: 4,542,635

[45] Date of Patent: Sep. 24, 1985

[54] APPARATUS FOR MANUFACTURING SOLID TENSION COIL SPRINGS HAVING ATTACHMENT LOOPS AT BOTH ENDS THEREOF

[75] Inventor: Takeji Matsuoka, Tokyo, Japan

[73] Assignee: MEC Machinery Co., Ltd., Tokyo, Japan

[21] Appl. No.: 682,491

[22] Filed: Dec. 18, 1984

Related U.S. Application Data

[63] Continuation of Ser. No. 491,804, May 5, 1983, abandoned.

[30] Foreign Application Priority Data

May 6, 1982 [JP] Japan ..... 57-75603

[51] Int. Cl.[4] ..... B21F 35/02

[52] U.S. Cl. ..... 72/14; 72/137; 140/103

[58] Field of Search ..... 72/14, 130, 131, 132, 72/137, 138, 145; 140/103

[56] References Cited

U.S. PATENT DOCUMENTS

| | | | |
|---|---|---|---|
| 873,430 | 12/1907 | Harter | 72/14 |
| 940,828 | 11/1909 | Sleeper | 140/103 X |
| 1,873,626 | 8/1932 | Nigro | 140/103 |
| 2,135,729 | 11/1938 | Olgay | 72/14 |
| 3,192,748 | 7/1965 | Lange | 140/103 X |
| 3,313,325 | 4/1967 | Wells | 72/137 X |
| 4,026,135 | 5/1977 | Yagusic et al. | 72/14 |

FOREIGN PATENT DOCUMENTS

| | | | |
|---|---|---|---|
| 2053612 | 5/1972 | Fed. Rep. of Germany | 140/103 |

*Primary Examiner*—E. Michael Combs
*Attorney, Agent, or Firm*—Oblon, Fisher, Spivak, McClelland & Maier

[57] ABSTRACT

Apparatus for manufacturing solid tension coil springs providing loops at both ends with excellent productivity under the condition that shape of loop, facing angle of loops at both ends and number of turns between the loops are respectively set accurately to the desired values characterized in that on the occasion of forming a solid tension coil portion by sending the wire material and abutting it in contact with the bending dies, when the end portion of the solid tension coil formed abuts in contact with the contact type sensor for control, sending of wire material is stopped and thereby a solid tension coil spring in the desired number of turns can be manufactured, then the coil spring is cut on the side of bending dies in the condition that said coil spring is held, thereafter said coil spring is sent to the next stage while it is held, and while the next coil spring is being manufactured, both loops are formed by raising simultaneously both ends of the solid coil spring being held.

1 Claim, 12 Drawing Figures

APPARATUS FOR MANUFACTURING SOLID TENSION COIL SPRINGS HAVING ATTACHMENT LOOPS AT BOTH ENDS THEREOF

This application is a continuation, of application Ser. No. 491,804, filed May 5, 1983, abandoned.

SUMMARY OF THE INVENTION

The present invention relates to apparatus for manufacturing solid tension coil spring having loops at both ends with excellent productivity under the condition that shape of loop, facing angle of loops at both ends and number of turns between the loops are respectively set accurately to the desired values.

BACKGROUND OF THE INVENTION

A tension spring is generally composed of solid tension coil spring in its greater part, but such tension coil spring is always required to have high severity such as in facing angle between the loops formed in both ends, shape of such loop, number of turns between these loops and diameter of coil etc. to be provided to suit place and purpose of application, and it is now an immediate need to develop an efficient and precise apparatus for manufacturing solid tension coil springs satisfying such requirements.

In the field of coil spring manufacturing, following three kinds of method for manufacturing a solid coil tension spring have been available.

(1) A method of executing four steps of forming the first loop, forming the coil portion and controlling the loop angle, forming the second loop and cutting with a single unit of the coil shaper while the wire material is intermittently sent with pressure.

(2) A method including the steps; First, loop is formed; then the wire material is sent under pressure and the coil portion is formed, loop angle is controlled and cutting is carried out; upon completion of cutting, such coil spring is moved to the next stage in order to form the second loop (in this case, the first loop of the next coil spring is formed simultaneously with the second loop).

(3) A method including the steps; The wire material is sent under pressure and the coil portion is formed followed by control of coil end angle; when cutting completes, such coil spring is sent to the next stage and the first loop is formed in such a stage; then such coil spring is sent to the next stage and such coil spring is placed reversely and caught again; thereafter the coil is sent to the next stage in order to form the second loop (in this case the respective steps are carried out simultaneously in each stage and in the coil portion forming step).

Investigations from various aspects for such existing methods of manufacturing solid coil spring have proved that the respective methods have the defects as explained below.

Method (1)

This method takes a longer time in manufacturing solid tension coil springs and is much inferior in productivity because the working steps such as formation of the first loop, formation of coil and control of loop angle and formation of the second loop are sequentially executed with a single device.

Method (2)

As compared with the above method (1), this method assures slightly higher productivity, but it still requires a longer time in manufacturing a solid tension coil spring and yet inferior in productivity because, as explained above, the working steps such as formation of the first loop, formaformation of the coil and control of loop angle and transfer of coil spring etc. are sequentially executed with a single device.

Method (3)

This method assures a very high productivity as compared with the above methods (1) and (2) because the respective steps such as transfer of coil spring, formation of each end loop, re-catching of coil spring etc. are executed in parallel with formation of coil. Moreover, this method also provides an advantage that considerable high speed operation is realized by taking the number of turns of coil into account such as strictly controlling the transfer length of wire material. However, this method results in such a disadvantage that since a coil spring is transferred to the re-catching process after the first loop is formed, the coil spring being held is released, placed reversely and then held again in such the re-catching stage and thereafter the coil spring is sent to the second loop forming process, angle error may be easily generated in the coil spring condition and the wire material is easily broken, and accordingly generation rate of defective coil spring becomes high because errors occur in the angle formed between the second and first loops (loop facing angle) and the shape of second loop (loop angle).

In addition, in the case of above methods (1) and (2), the coil of the solid tension coil spring is formed after the first loop is formed. Therefore, in case of controlling a winding angle, a contact type sensor for control is placed at a high speed into the pre-determined one side of the first loop for making contact and it must be confirmed that the coil portion in the desired number of turns has formed. However, very high accuracy is actually required for placing the contact type sensor for control in timing to the area corresponding to the coil which moves while rotating at a high speed as explained above. Meanwhile, the other parts for forming the solid tension coil springs are not finished with so high accuracy and it has been inevitable to maintain the accuracy by drastically lowering the manufacturing rate and it has accordingly been hardly possible to raise manufacturing efficiency.

OBJECT OF THE INVENTION

As a result of diversified researches and trial manufacturing to eliminate defects of such solid tension coil spring manufacturing methods in existence, the inventors of the present invention have completed the present invention by finding that solid tension coil springs which do not have errors in the opposing angle of both loops, loop angle and the number of turns of a solid coil spring and have the loops at the both ends can be manufactured with a high precision can be obtained from the following steps;

first, a solid coil portion is formed by the coil spring forming machine of such a type that the bending dies is used for solid coil formation, namely by the coil spring forming machine of such a type that the wire material is sent by the pressurized roller and abuts in contact with the bending dies, then sequentially bent into coil and when once formed into a coil the coil portion is automatically subjected to the spring back because nothing abuts in contact with the coil portion and the number of turns or shape of coil no longer change;

in this coil forming process, if the control for the number of turns of solid coil spring is carried out in such a manner that the control contact type sensor is located at the predetermined position and the pressurized sending of wire material is immediately stopped when the end of wire material of the formed coil portion abuts in contact with such control contact type sensor, such solid coil spring is cut at the specified position of the formed coil since the formed solid coil accurately has the specified number of turns; and the solid coil spring which is cut in the specified number of turns is held at the center thereof and is transferred to the next stage and the first and second loops are simultaneously formed at both ends of such solid coil spring in this transfer process.

In other words, the present invention relates to apparatus for manufacturing solid tension coil springs, characterized in that the pressurized sending of wire material is immediately stopped when the end portion of solid coil spring formed abuts in contact with the contact type sensor for control on the occasion of forming a solid coil spring by pressuring said wire material for sending and abutting it in contact with the bending dies and thereby a solid coil spring of the predetermined number of turns can be manufactured, and then after said solid coil spring is cut on the side of bending dies under the condition that said solid coil spring is held, said coil spring is transferred to the next stage while it is being held and while the next solid coil spring is manufactured, both loops are formed at both ends of a solid tension coil spring being held.

BRIEF DESCRIPTION OF THE DRAWINGS

In the attached drawings

DETAILED DESCRIPTION OF THE INVENTION

Figure 1:
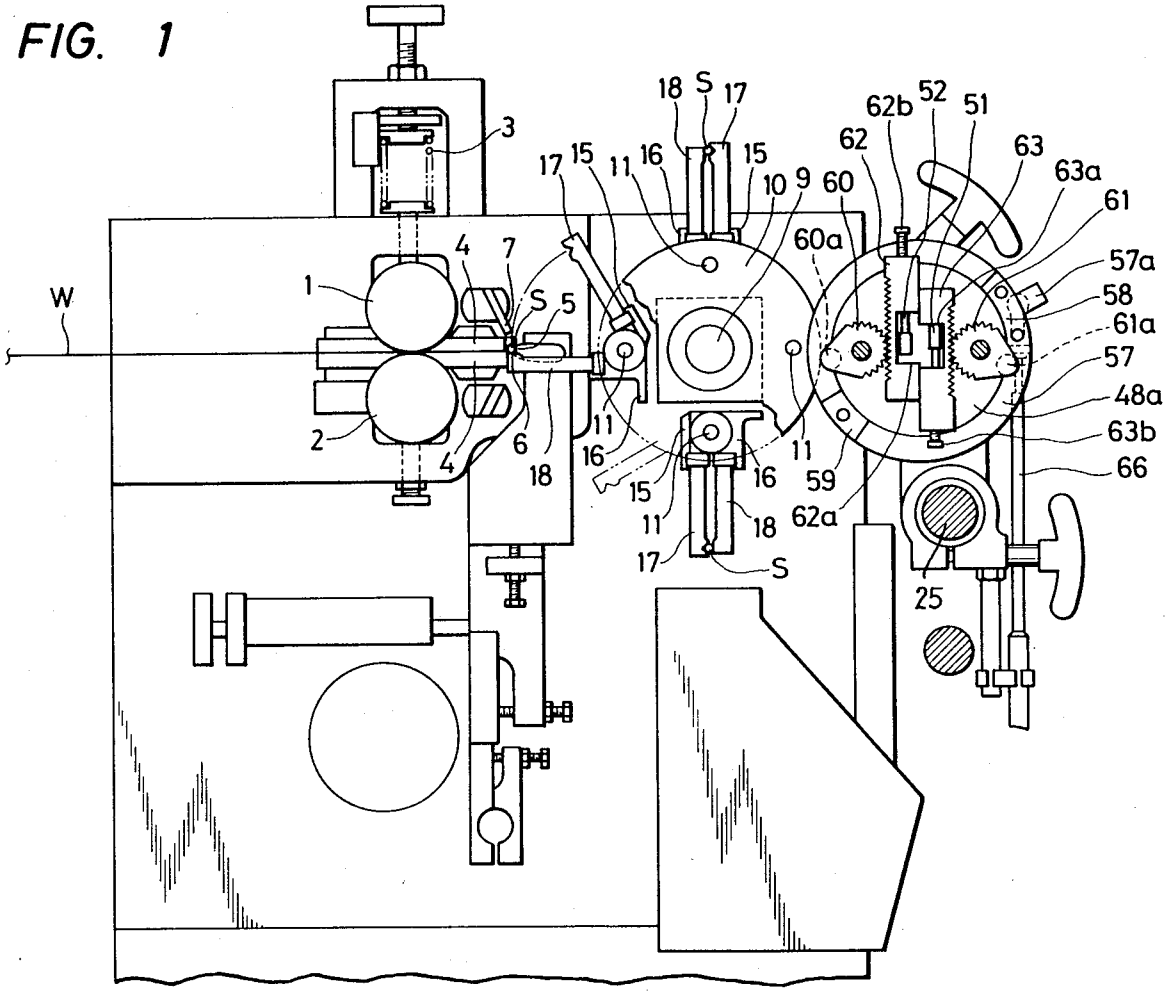
FIG. 1 is the front view for explaining a preferred embodiment of a solid tension coil spring to which the present invention is applied.
Figure 2:
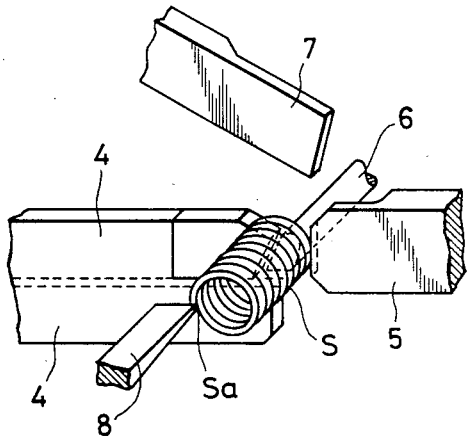
FIG. 2 is the perspective view indicating the coil portion of a solid tension coil spring is formed.

With reference to above attached drawings, a preferred embodiment of the apparatus for manufacturing solid tension coil springs is now explained hereinafter in detail.

In the figures, W is a wire material to be formed into a solid tension coil spring. 1 and 2 are pressurized rolls which send the wire material W by holding it between them and are driven by the motor such as a pulse motor which can be brought to a sudden stop. 3 is a compression spring which presses the pressurized roll 2 to the pressurized roll 1 so as to reliably hold the wire material W between the pressurized rolls 1 and 2. 4 is a wire guide which forms the groove for supplying the wire material W sent by the pressurized rolls 1 and 2 to the specified direction, and 5 is one or more bending dies (only one is used in the embodiment shown) which forms a solid coil spring by bending the wire material W with the specified radius of curvature when the wire material W sent through the wire guide 4 abuts in contact thereto. In the present invention, since the coil portion forming system using this bending dies 5 is employed, the wire material W having passed the bending dies 5 performs spring back because nothing is provided for contactness and formed into a solid tension coil spring S having a coil diameter of stabilized dimension larger than the radius of curvature by the bending dies 5. 6 is a fixed cutter or blade for cutting the solid coil spring S on the side of bending dies 5 in combination with the movable cutter or blade. This fixed blade 6 is located within the formed solid tension coil spring S. 8 is a contact type sensor for control which is in contact with the bending dies 5 and also abuts in contact with the end portion Sa of the solid coil spring S consisting of the wire material W allowing formation of the coil portion. The wire material W having formed the coil portion is in contact, in its pressurized sending process, with the roller leveler not shown, pressurized rolls 1, 2, wire guide 4 and dies 5 and accordingly it is considered to be earthed to the body of system. Therefore, when the end portion Sa of the solid coil spring S abuts in contact with the contact type sensor 8 for control, the circuit closes and the control gate of motor drive circuit for driving the pressurized rolls 1, 2 opens, thereby the motor comes to a sudden stop and the coil portion is completed. The reason for such a contact type sensor 8 for control and motor is used is that if the wire material W is formed into a solid coil spring S by the bending dies 5 as explained above, the diameter of coil S changes due to the spring back of the wire material W and accordingly the number of turns cannot be accurately controlled by the amount of feed of wire material W.

Figure 6:
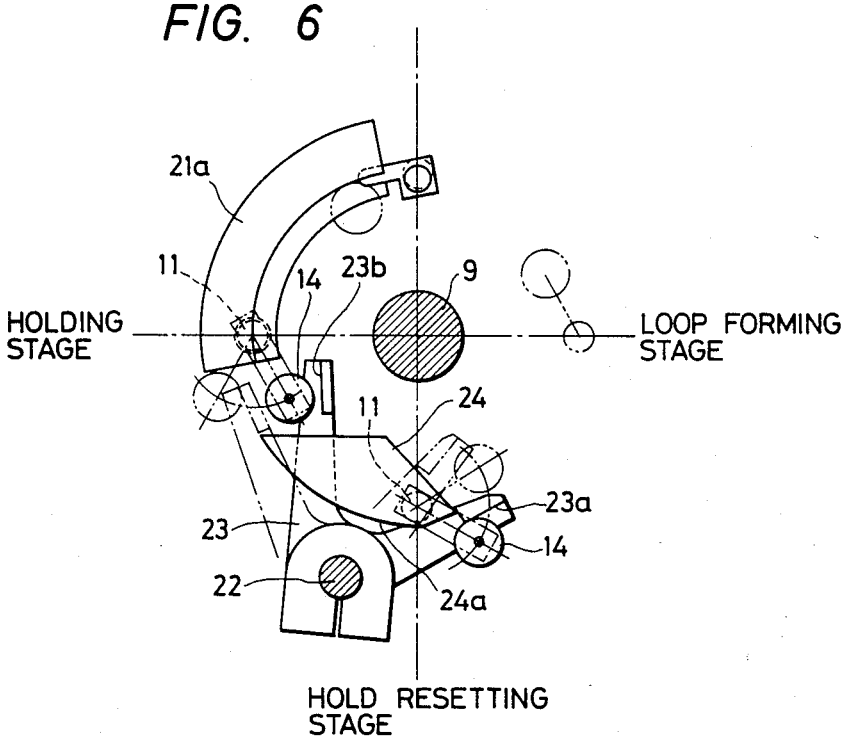
FIG. 6 shows relation between the cam follower and cam which are fixed to the rear end portion of the spindle shown in FIG. 4.
Figure 7:
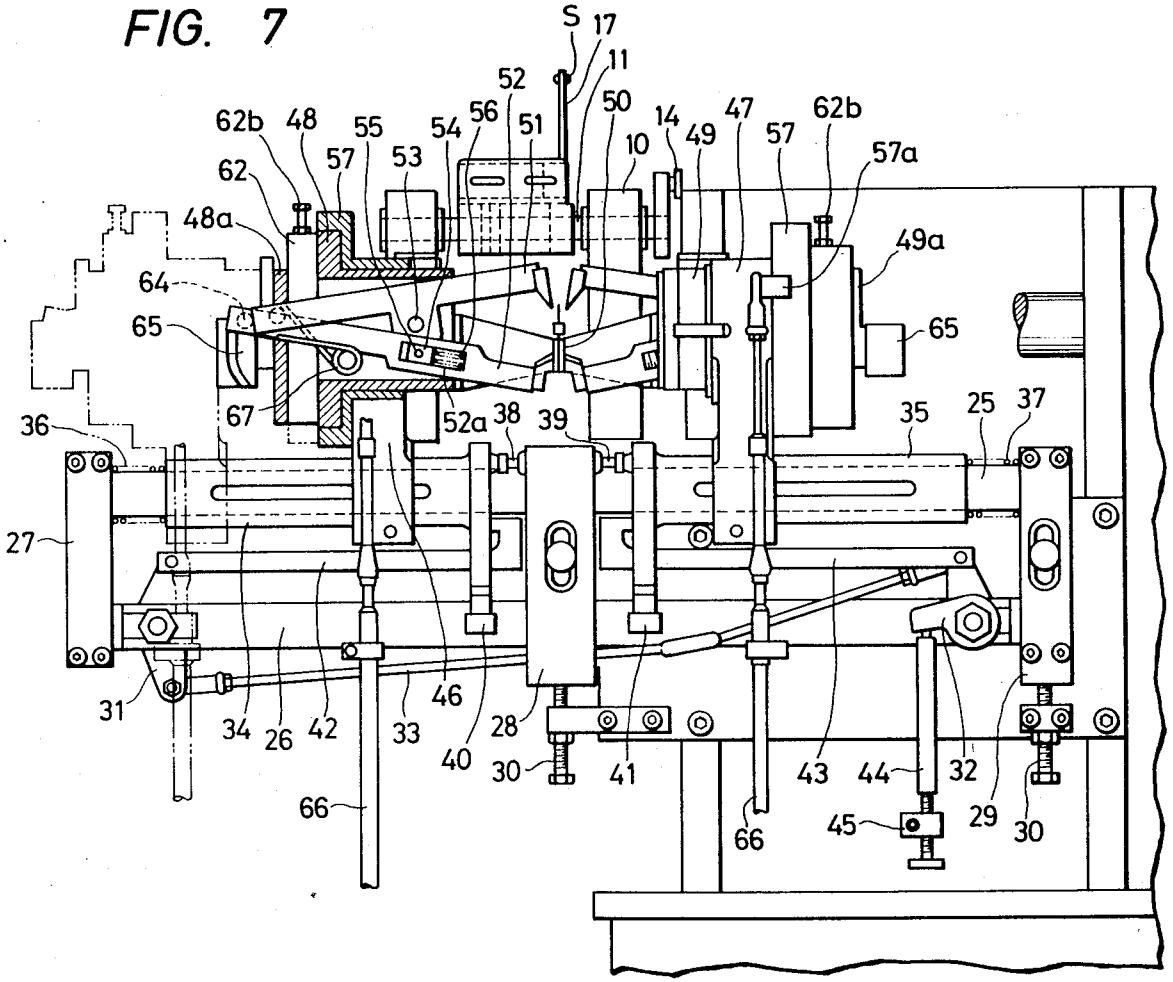
FIG. 7 is a side view for explaining the structure for drawing simultaneously the loops at both ends of a solid tension coil spring.

9 is an intermittent rotation shaft for holding and transferring the solid coil spring S which is composed only of solid tension coil portion of which number of turns is controlled, and this intermittent rotation shaft 9 is intermittently rotated by the drive system which causes the intermittent rotation by the means such as the cam mechanism or the Geneva gear. The drive shaft for driving the drive system which causes the intermittent rotation shaft 9 to rotate intermittently must be driven in synchronization with the motor which drives the pressurized rolls 1, 2 for sending the wire material W as mentioned above. Therefore, it is desirable that such shaft is integrated in the coil spring forming system but it may also be mounted separately to the coil spring forming system. In the drive system for the intermittent rotation, the intermittent rotation shaft 9 which is an output shaft of it used in the present embodiment is the most desirable. Namely, it intermittently rotates for 90 degrees for the $\frac{1}{3}$ rotation of the main drive shaft which is the input shaft but not rotates for the remaining $\frac{2}{3}$ rotation of the main drive shaft. Therefore, the intermittent rotation shaft 9 makes a turn while the main drive shaft makes four turns and stops four times during a turn. But the present invention requires the process for holding a solid coil spring S forming the coil portion and the process for forming the loops simultaneously to both ends of a solid coil spring S. Therefore, it is enough that the intermittent rotation shaft 9 stops two times or more during a single turn. 10 is a boss fixed to the intermittent rotation shaft 9. The boss 10 supports rotatably and slidably the four spindles 11 which is the same in number as the number of times of stoppage during a single rotation of the intermittent rotation drive system. 12 is a compression and torsion coil spring of which one end engages with the slot portion 11*a* being provided at the front end of the spindle 11 and the other end enages with the slot portion 13*a* provided at the end portion of the torque adjusting screw 13 and presses backward the spindle 11. 14 is a cam follower being fixed to the rear end of the spindle 11. 15 is a fixed block being fixed to the center portion of spindle 11. To this fixed block 15, the one clamp arm 17 holding the solid coil spring S is fixed. 16 is a rotatable block which is rotatably mounted at the center of spindle 11 in such a manner that the positional relation to the fixed block 15 is not changed. To this rotatable block 16, the other clamp arm 18 which holds the solid coil spring S in combination with the clamp arm 17 is fixed. 19 is an adjusting bolt for controlling the ordinary stop position of the rotatable block 16. 20 is a tension coil spring for attracting the rotatable block 16 to the specified position by the adjusting bolt 19. 21 is a spindle which is driven by the drive shaft of drive system which intermittently rotates the intermittent rotation shaft 9 and is caused to move intermittently toward the spindle 11 in order to move the solid coil spring in its axial direction until said coil spring S separates from the fixed blade 6 immediately after the solid coil spring S is held by both the above-mentioned clamp arms 17 and 18 and is cut by the fixed blade 6 and movable blade 7. 21*a* is a circular cam being fixed to the spindle 21 and the cam follower 14 being fixed to the rear end of the spindle 11 explained above moves along this cam 21*a*. 22 is a spindle which is driven by the drive shaft of the drive system which intermittently rotates the intermittent rotation shaft 9 mentioned above and rotates swayingly for the specified angle. 23 is a Y-shaped lever being fixed to the spindle 22 having the working surface 23*a* which engages with the cam follower 14 fixed to the spindle 11 located at the hold resetting stage shown in FIG. 6 and the working surface 23*b* which engages with the cam follower 14 fixed to the spindle located at the holding stage. 24 is a guide plate fixed between the hold resetting stage and the holding stage, of which guide surface 24*a* causes the cam follower 14 being pressed by the working surface 23*a* of the L-shaped lever 23 to directly move to the holding stage. 25 and 26 are shafts fixed to the predetermined height for the drive system which rotates intermittently as explained previously. These shafts 25 and 26 are fixed to the three blocks 27, 28, 29. Their moving directions are controlled by the bolts passing through the elongated holes bored at the center of a side of two blocks 28 and 29 among said three blocks and the fixing heights of them are restricted by the adjusting screw 30. 31 and 32 are swaying arms which are respectively rotatably mounted in both ends of the one shaft 26. These swaying arms 31 and 32 are mutually coupled by the pull link 33. 34 and 35 are sleeves which are respectively and precisely engaged slidably by inserting to the other shaft 25 in such a manner as sandwiching the block 28 at the center from both sides. These sleeves 34, 35 are always pressed respectively to the side of block 28 at the center by the compression springs 36, 37 which are respectively engaged with the shaft 25 from the outside and abuts in contact at the other ends to the blocks 27, 29, so that they stop at the position corresponding to the position of both ends of the solid tension coil spring S sent from the adjusting bolts 38, 39 respectively provided to the block 28 at the center. 40, 41 are stop rollers for preventing rotations of sleeves 34, 35 around the shaft 25 by holding the one shaft 26 from both sides. 42, 43 are key-shaped links having the key-portions being coupled respectively to the sleeves 34, 35 of which one ends are pin jointed respectively to the swaying arms 31, 32 rotatably loaded to the shaft 26, while the other ends are slidably engaged with the shaft 25. 44 is a tie rod coupled to the one swaying arm. This tie rod 44 is vertically swayed intermittently by the swaying lever 45 which is intermittently swayed by the drive shaft of the drive system for intermittently swaying the rotating shaft 9 mentioned above. 46, 47 are brackets fixed to the specified location of the sleeves 34, 35. Fixed to these brackets 46, 47 are the cylindrical forming stages 48, 49, matching the number of turns of the solid tension coil spring S manufactured. Namely, these forming stages 48, 49 can rotate on the upper portions of the brackets 46, 47 and can be fixed corresponding to change of the loop (or facing) angle of the solid coil spring S. 50 is a wedging tool having the wedge portion at the end portion thereof. This wedging tool is respectively fixed to the forming stages 48 and 49 and such wedge portion goes separatingly into the wire material W of the solid coil spring S. 51 is a squeezing tool which squeezes the solid coil spring S in the end portion side from the portion being engaged with the groove 51*a* by engaging the wire material W of the solid coil spring S with the groove 51*a* provided at the end portion. 52 is a loop raising tool which forms loops by dipping up and raising the end portion of the solid coil spring S being moved along the wedge tool 50 and squeezed by the squeezing tool 51. 53 is a fixed shaft projected respectively in the forming stages 48, 49. This fixed shaft 53 allows motionable loading of the squeezing tool 51 as explained above and 54 is the fixed shaft projected respectively at the lower part of the fixed shaft 53 within the forming stages 48, 49. This fixed shaft 54 allows rotatable loading of the sliding piece 55 which is slidably inserted into the long groove 52*a* provided at the center of aforementioned loop raising tool 52. Since the sliding piece 55 is being pressed by the compression spring 56 loaded within the long groove 52*a* of the loop raising tool 52, the loop raising tool 52 is always slightly pressed to the wedge tool 50. 57 is a ring which is rotatably engaged with a play to the circumference of the forming stages 48, 49. The squeezing cam 58 and loop raising cam 59 are loaded at the specified position which is furthest from the wedge tool 50 of the ring 57, the pinions 60, 61 having the cam followers 60*a*, 61*a* are deposited at the end portions which are furthest from the wedge tool 50 of the forming stages 48, 49 at the inside of such ring and a pair of racks 62 and 63 which are abutting in contact mutually at the rear surfaces in the central portion are respectively engaged with said pinions 60 and 61.

The pinions 60,61 and racks 62,63 are respectively loaded to the holding covers 48*a*, 49*a* attached to the forming stages 48, 49.

A pair of racks 62, 63 respectively provided with the cut-away portions 62*a*, 63*a* at the central portions in both sides abutting therewith, the rear portions of the squeezing tool 51 and loop raising tool 52 are passing through the cut-away portions 62*a* and 63*a* and the respective locations are restricted by the adjusting screws 62*b*, 63*b*. 64 is a roller attached to the rear end of the loop raising tool 52. This roller 64 is engaged with the flat cam 65 which is adjustably mounted to the holding covers 48*a*, 49*a* respectively attached to the forming stages 48, 49 in order to hold the racks 62, 63 and pinions 60, 61. 66 is a pair of wire cables where the one end is fixed to the ring 57 through the clamp 57*a*, while the other end is coupled to the wire drive system which operates in conjunction with the drive shaft of the drive system for intermittently rotating the aforementioned intermittent rotation shaft 9. When this wire cable 66 is simultaneously pulled by the wire drive system, the ring 57 respectively rotates around the forming stages 48, 49. 67 is a torsion coil spring of which both ends are coupled to the squeezing tool 51 and loop raising tool 52 within the forming stages 48, 49.

The operations of the system disclosed in the present invention having the above-described structure is now explained hereinunder in detail.

Figure 3:
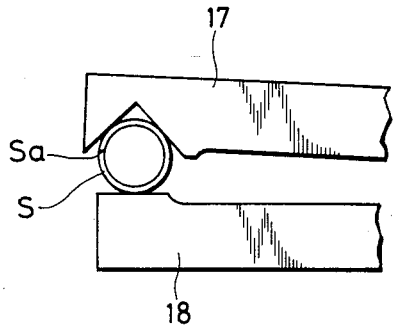
FIG. 3 shows enlarged shape of the clamp arm end point which holds a solid tension coil spring having formed the coil portion.
Figure 4:
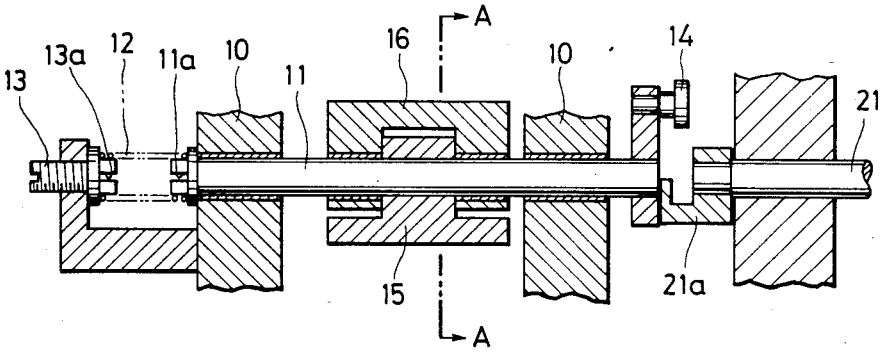
FIG. 4 is the vertical cross-sectional view indicating the fitting condition of the clamp arm mounting spindle for the boss.
Figure 5:
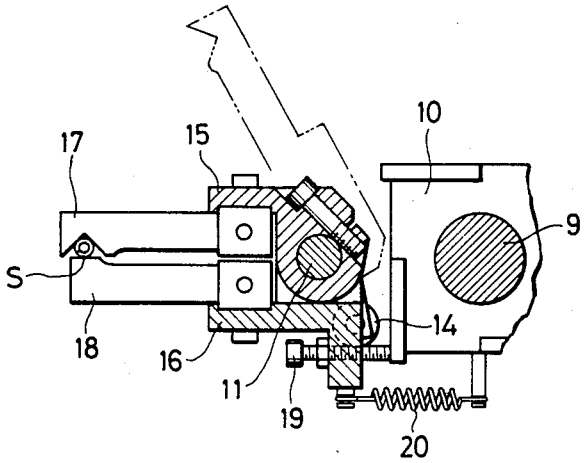
FIG. 5 is the cross-sectional view along the line A—A in FIG. 4.

First, when the start switch (not shown) of the system is operated, the wire material W, which goes to the bending dies 5 through a pair of pressurized rolls 1 and 2 of which pressing force is adjusted by the compression spring 3 and the wire guide 4, is sent to the bending dies 5 by a driving force of the pressurized rolls 1, 2. Then, the portion abutting in contact with the bending dies 5 is sequentially bent forming the solid coil portions. When the end portion Sa of such solid coil portion formed abuts in contact with the contact type sensor 8 for control, drive of the pressurized rolls 1, 2 stops and sending of the wire material W also stops. Then, the intermittent rotation shaft 9 immediately rotates for only 90 degrees by means of the drive system for intermittent rotation and the solid coil spring S is held by the clamp arms 17 and 18 which are loaded to the spindle 11 being rotatably and slidably supported by the boss 10 which is fixed to this intermittent rotation shaft 9. When the intermittent rotation shaft 9 rotates for 90 degrees and the spindle 11 located just below the intermittent rotation shaft, namely located at the hold resetting stage of the solid tension coil spring S stops at the solid coil spring S holding stage between the intermittent rotation shaft 9 and the bending dies 5, the one clamp arm 18 stops at the position of the clamp arm 18 shown in FIG. 3 which is just abutting in contact with the circumference of the solid coil spring S because it is fixed to the rotatable block 16 of which location to the boss 10 is restricted by the adjusting bolt 19 and tension coil spring 20. Moreover, the other clamp arm 17 is pressed by the working surface 23*a* of the Y-shaped lever 23 being fixed to the spindle 22 which causes the cam follower 14 fixed to the rear end of the spindle 11 to swayingly rotate by the drive shaft of the drive system for intermittent rotation, thereby the spindle 11 is given in the hold resetting stage the condition that it is rotated in such a direction as giving a torque to the compression and torsion coil spring 12, the spindle 11 maintains, on the occasion of rotating to the holding stage by means of the boss 10, the condition that it is rotated in such a direction as giving a torque to the compression and torsion coil spring 12, because the cam follower 14 transfers to the condition where it abuts in contact with the other working surface 23*b* of the Y-shaped lever 23 through the condition where it abuts in contact with the guide surface 24*a* of the guide plate 24 being fixed to the location between the hold resetting stage and holding stage, therefore the other clamp arm 17 fixed to the spindle 11 through the fixed block 15 moves to the holding stage while it is opening to the clamp arm 18. When the spindle 22 rotates again and the Y-shaped lever 23 returns to the initial condition in such a condition, contact between the working surface 23*b* of the Y-shaped lever 23 having pressed the cam follower 14 and the cam follower 14 is reset, the spindle 11 rotates to the initial condition by a torque of the compression and torsion coil spring 12. When the spindle 11 rotates, the clamp arm 17 which has been fixed to the spindle 11 through the fixed block 15 also rotates and holds a formed solid coil spring S in combination with the claim arm 18 as shown in FIG. 3. When a solid coil spring S is thus held by the clamp arms 17 and 18, the movable blade 7 moves and cut the solid coil spring S in combination with the fixed blade 6 at the position resulting in the correct number of turns. When a coil spring S is cut away, the spindle 21 which is driven by the drive shaft of the drive system for intermittent rotation is coming out moving the cam 21*a* forward. Thereby, the cam 21*a* presses the cam follower 14 and accordingly the spindle 11 moves forward. Since the clamp arms 17 and 18 are loaded to this spindle 11, when the spindle 11 moves forward, the clamp arms 17 and 18 holding a solid coil spring S moves said coil spring S in the axial direction until the coil spring S in the bending dies 5 side is separated from the fixed blade 6. Under this condition, the cam follower 14 is transferred to the location where it is moved along the cam 21*a* fixed at the front end of the spindle 21. Thereby, when the intermittent rotation shaft 9 is rotated by 90 degrees in such a condition, the spindle 11 gradually recovers to the not-pressed-condition from the forwardly-pressed condition in the process that the cam follower 14 rotates along the cam 21*a*. Thereafter, when the intermittent rotation shaft 9 further rotates for 90 degrees and the clamp arms 17 and 18 move to the loop forming stage, the swaying arm 32 and the swaying arm 31 which is coupled to such arm 32 through the pull-link 33 are respectively caused to rotate through the tie rod 44 around the rotation center provided to the shaft 26 by means of the swaying lever 45 which is separately driven by the drive shaft of the drive system which intermittently rotates the intermittent rotation shaft 9 just before the movement of the clamp arms. Thereby, the key-shaped links 42, 43 being coupled respectively to these swaying arms 31, 32 cause the sleeves 34, 35 being pressed slidably along the shaft 25 to the block 28 at the center by the compression springs 36, 37 to slide toward the blocks 27 and 29 in both sides. These sleeves 34, 35 are respectively provided with the fixed brackets 46, 47 which are provided with the fixed cylindrical forming stages 48 and 49 which are then provided with the fixed wedge tool 50. Therefore, a solid coil spring S which is held by the clamp arms 17, 18 and moves while it is rotating around the intermittent rotation shaft 9 stops in the condition that the portions near to both ends are abutting in contact with the wedge tool 50.

Figure 8:
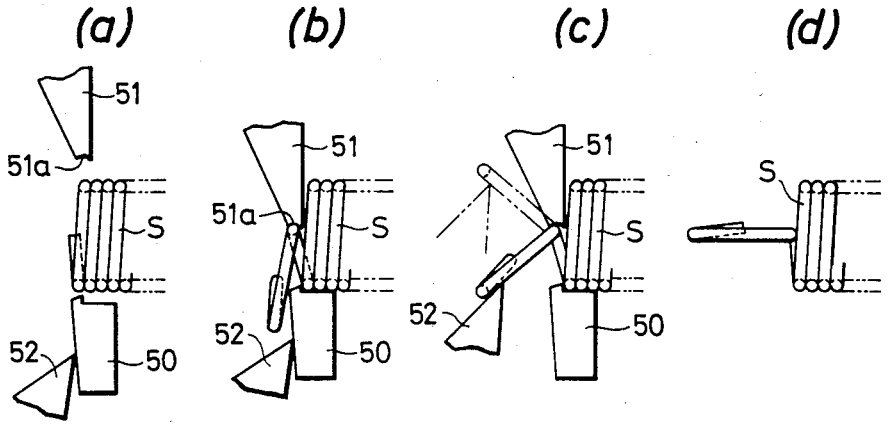
FIG. 8 (*a*),(*b*),(*c*),(*d*) show the processes for forming the loops to the solid tension coil spring.
Figure 9:
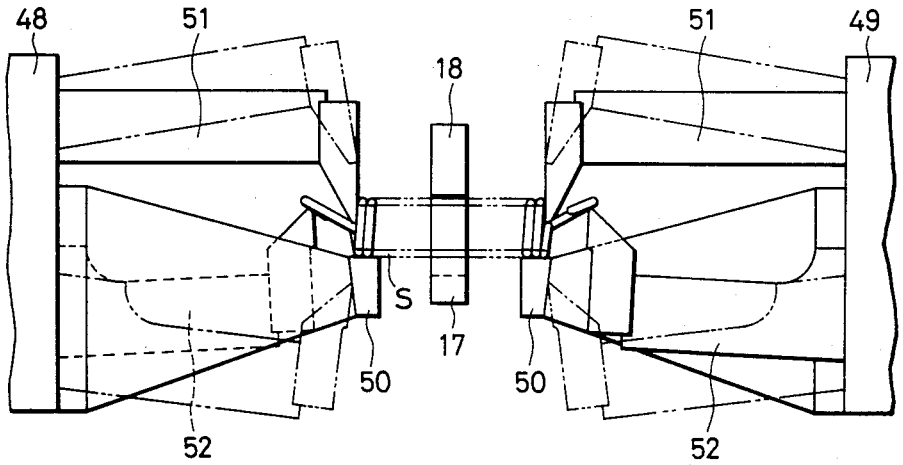
FIG. 9 shows a condition where the loops are formed at both ends of a solid tension coil spring.

Here, a pair of wire cables 66 are simultaneously pulled by the wire driver which is separately driven by the drive shaft of the drive system which intermittently rotates the intermittent rotation shaft 9 and the rings 57 to which the one ends of the wire cable 66 is fixed respectively through the clamp 57*a* are rotated only for the specified angle around the forming stages 48, 49. Rotation of the ring 57 causes the squeezing cam 58 and loop raising cam 58 loaded to the ring 57 to move in integration with the ring 57, and to engage with the cam followers 60*a*, 61*a* of the pinions 60, 61. Accordingly the pinions 60, 61 rotate, followed by movement of racks 62, 63 which are engaging with the pinions 60, 61 and are loaded to the protection covers 48*a*, 49*a* of the forming stages 48, 49 rotatably loading the pinions 60, 61. Since the racks 62, 63 allow the squeezing tool 51 and loop raising tool 52 to pass through the cut-away portions 62*a*, 63*a* provided at the center portion thereof, the end portions of the squeezing tool 51 and loop raising tool 52 are moved in the direction to the solid coil spring S due to the movement of the racks 62, 63 and the loop formation consisting of the squeezing and dipping-up is carried out as shown in FIG. 9 in accordance with the process shown in FIG. 8. For the loop formation, the operation of the squeezing tool 51 of which rear portion is moved by movement of the rack 62 is reliable because it is loaded rotatably to the fixed shaft 53 projected within the forming stages 48, 49 and is coupled with the other tool for loop formation, the loop raising tool 52, through the torsion coil spring 67. Meanwhile the operation of the loop raising tool 52 of which rear portion is moved by movement of the rack 63 is also reliable because the sliding piece 55 loaded rotatably to the fixed shaft 54 projected within the forming stages 48, 49 is slidably inserted into the long groove 52*a* provided at the center, further such sliding piece 55 is slightly pressed to the wedge 50 by means of the compression spring 56 inserted also into the long groove 52*a* and the roller 64 attached to the rear portion thereof moves in engagement with the flat cam 65 fitted to the protection covers 48*a*, 49*a* mounted to the forming stages 48, 49. When loop formation completes by the wedge tool 50, squeezing tool 51 and the loop raising tool 52, the system returns to the initial condition by the following sequence that the pulled wire cable 66 is released, the ring 57 rotates in the direction opposing to the direction explained above, the squeezing tool 51 and loop raising tool 52 separate from the formed solid tension coil spring S with a help by the torque of torsion coil spring 67, the swaying lever 45 moves in the direction opposing to that explained above while the clamp arms 17, 18 holding a solid tension coil spring S forming the loops are further rotated for 90 degrees by means of the intermittent rotation shaft 9 around it, and the sleeves 34, 35 move along the shaft 25 until it abuts in contact with the adjusting bolts 38, 39 by the effect of the compression springs 36, 37.

When the spindle 11 loading the clamp arms 17, 18 which is holding a solid tension coil spring S forming the loops rotates for 90 degrees from the loop forming stage by the intermittent rotation shaft 9, the Y-shaped lever 23 is rotated by the spindle 22 as explained above, the cam follower 14 is pressed by the working surface 23*a* of the Y-shaped lever 23 causing the spindle 11 to rotate in such a direction as giving a torque to the compression and torsion coil spring 12 and thereby the clamp arm 17 opens, and accordingly a solid tension coil spring S being held by the clamp arms 17, 18 is released.

Above operations are respectively carried out in each portion for every $\frac{1}{4}$ turn of the intermittent rotation shaft 9.

The apparatus for manufacturing solid tension coil spring disclosed herein is only an embodiment, and it is also possible, for examaple, to form a thin plate to be inserted between wire materials of solid coil portion as the clamp arm 17 in place of the holding method where a solid coil spring S of which solid coil portion is formed by the bending dies 5 is held by the clamp arms 17 and 18. In this case the clamp arm 18 is not required to rotate in integration with the intermittent rotation shaft 9. Namely, the present invention certainly allows diversified modifications of design.

The apparatus for manufacturing solid coil spring disclosed herein provides the following excellent advantages and shows very high industrial values. (1) The time required for manufacturing a single piece of solid tension coil spring becomes almost equal to that used for formation of coil portion of a solid coil spring. High manufacturing efficiency can be ensured because the process for forming the coil portion of a solid coil spring is separated from the process for holding a solid tension coil spring and transferring it and then forming simultaneously the loops at both ends in the course of such transfer. (2) Since a method of forming a solid coil portion by sending a wire material and abutting it in contact with the bending dies in order to form the coil portion of a solid coil spring is employed, the wire material after separating from the bending dies performs the spring back and is in the condition not changing the shape etc. Therefore, a solid coil spring having the accurate number of turns including the loop portions can be obtained by suspending transfer of wire material when the end portion of wire material having formed a solid coil portion abuts in contact with the contact type sensor for control. As a result, the number of turns of a solid coil portion, angle of the loop portion and opposing angle of both loops of a coil as the final product can be accurately adjusted. (3) Both loops are formed simultaneously. Therefore the loop can be formed without changing the holding condition of the solid coil spring having formed the coil portion. Accordingly, a precise solid tension coil spring can be formed with accurate opposing angle of loops and accurate loop angle. (4) In case the number of turns is large, the clamp system is employed or in case it is small, the method for inserting a thin plate between the wire materials of the solid coil is employed for sending the solid coil spring to the loop forming stage and thereby various kinds of solid tension coil springs can be manufactured with a high precision. Even a solid tension coil spring in a small number of turns, of which solid coil portion did not allow re-catching for the existing system, can be manufactured with high precision by using a thin plate as explained above.

What is claimed is:

1. Apparatus for manufacturing solid tension coil springs having attachment loops at both ends thereof, said apparatus comprising:

(a) first means for bending a wire into a solid tension coil spring body;

(b) second selectively operable means for feeding a wire to said first means;

(c) third means for sensing when a solid tension coil spring body formed by said first means has reached a predetermined length and for stopping the feeding of the wire to said first means when the solid tension coil spring body has reached that length;

(d) a shaft;

(e) fourth means for intermittently rotating said shaft through 1/n revolutions (n being a positive integer) when said third means senses that the solid tension coil spring body has reached its predetermined length, whereby said shaft is rotated to n positions during each complete revolution of said shaft;

(f) fifth means mounted on said shaft for releasably grasping a solid tension coil spring body when said shaft is in the first of the n positions;

(g) sixth means for severing the wire at the upstream end of the solid tension coil spring body, whereby the apparatus initially forms intermediate products comprising a solid tension coil spring body which does not have an attachment loop at either end thereof;

(h) two wedge tools sized and shaped to slide between adjacent coils of the solid tension coil spring body and to force the adjacent coils apart;

(i) seventh means for simultaneously forcing one of said wedge tools between the last and the next-to-last coil at each end of each solid tension coil spring body while said shaft is in another of the n positions;

(j) eighth means for simultaneously forming the last coil at each end of each solid tension coil spring body into an attachment loop while said shaft is in said another of the n positions after said seventh means has forced the last coil at each end away from the adjacent coil;

(k) ninth means for selectively varying the relative spacing and angular orientation of said seventh and eighth means so that the apparatus can be used to form attachment loops at both ends of solid tension coils spring bodies having different facing angles between the attachment loops and so that the apparatus can be used to form attachment loops at both ends of solid tension coil spring bodies having different numbers of turns and/or different diameters; and (l) tenth means for releasing a formed solid tension coil spring having attachment loops at both ends thereof from the grasp of said fifth means after said eighth means has formed the attachment loops.

* * * * *